US006715564B2

(12) United States Patent
Buckland

(10) Patent No.: US 6,715,564 B2
(45) Date of Patent: Apr. 6, 2004

(54) HYDRAULIC DRILLING RIG

(76) Inventor: Ricky Eric John Buckland, 133 The Promenade, Sans Souci, New South Wales 2219 (AU)

( * ) Notice: Subject to any disclaimer, the term of this patent is extended or adjusted under 35 U.S.C. 154(b) by 0 days.

(21) Appl. No.: 10/130,862

(22) PCT Filed: Dec. 6, 2000

(86) PCT No.: PCT/AU00/01501

§ 371 (c)(1),
(2), (4) Date: Aug. 13, 2002

(87) PCT Pub. No.: WO01/42616

PCT Pub. Date: Jun. 14, 2001

(65) Prior Publication Data

US 2003/0051888 A1 Mar. 20, 2003

(30) Foreign Application Priority Data

Dec. 9, 1999 (AU) ..... PQ4541

(51) Int. Cl.[7] ..... E21C 11/02

(52) U.S. Cl. ..... 173/184; 173/28; 173/44; 173/93

(58) Field of Search ..... 173/184, 185, 173/28, 39, 42, 193, 44, 152

(56) References Cited

U.S. PATENT DOCUMENTS

| | | | | | |
|---|---|---|---|---|---|
| 3,645,343 | A | * | 2/1972 | Mays | 173/28 |
| 3,867,989 | A | * | 2/1975 | Hisey et al. | 173/28 |
| 4,785,892 | A | * | 11/1988 | Luen | 173/39 |
| 5,647,442 | A | * | 7/1997 | Lange | 173/184 |
| 5,799,738 | A | * | 9/1998 | Kromray, Jr. | 173/193 |
| 6,533,045 | B1 | * | 3/2003 | Cooper | 173/28 |

FOREIGN PATENT DOCUMENTS

| | | |
|---|---|---|
| AU | 568378 | 12/1984 |
| AU | 28339/84 | 12/1984 |
| AU | 697366 | 1/1996 |
| AU | 728789 | 1/1999 |
| CA | 2128252 | 4/1996 |
| EP | 0884447 | 12/1998 |
| GB | 2163372 | 2/1986 |
| GB | 2182372 | 5/1987 |
| WO | 00/34617 | 6/2000 |

* cited by examiner

*Primary Examiner*—Scott A. Smith
(74) *Attorney, Agent, or Firm*—Ladas & Parry

(57) ABSTRACT

A drilling rig (10) having a boom (12) supporting a leader (36). The leader (36) is pivotally attached to the boom and is moveable between a generally upright orientation and a generally horizontal orientation for the purposes of transportation by a vehicle (11). Hydraulic rams (33) cause linear movement of the leader relative to the boom while the hydraulic ram (33) causes tilting of the boom about a generally horizontally axis.

7 Claims, 5 Drawing Sheets

HYDRAULIC DRILLING RIG

TECHNICAL FIELD

The present invention relates to hydraulic drilling rigs.

BACKGROUND OF THE INVENTION

Previously available drilling rigs have suffered a number of disadvantages such as size which has inhibited access to restricted sites. Further disadvantages including costly setting up procedures and difficulty in attempting to sloping ground surfaces. A still further problem is the cost of transporting the drilling rigs.

Previous drilling apparatus are described in Australian patents 568378 and 697366 as well as Australian applications 76103/98 and 20175/00.

The drilling apparatus which are the subject of the above mentioned patent specifications. The devices of the specifications do not overcome the problems discussed above.

OBJECT OF THE INVENTION

It is the object of the present invention to overcome or substantially ameliorate at least one of the above disadvantages.

SUMMARY OF THE INVENTION

There is disclosed herein a drilling rig to be mounted on a vehicle providing hydraulic fluid under pressure, said rig including:

- a telescopic boom having a first and second end, said first end being adapted to be pivotally attached to said vehicle for movement about a generally horizontal first axis;
- a first hydraulic ram mounted on the boom to cause telescopic extension and retraction thereof;
- a leader pivotally mounted on the second end for movement about a generally horizontal second axis, the second axis being generally transverse of said boom, the leader being adapted to support a drilling assembly;
- a second hydraulic ram, the second ram being pivotally attached to said boom and pivotally attached to said leader and operable to cause linear movement of said leader relative to said boom;
- an assembly attaching said second end to said leader to provide for said linear movement of said leader relative to said second end in a direction generally perpendicular to said second axis; and
- a third hydraulic ram, the third ram extending between said boom and leader and being pivotally attached to the leader at a location spaced from said second end for pivoting movement about a generally horizontal fourth axis, the third ram being operable to cause pivoting of said leader about said second axis.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 3:
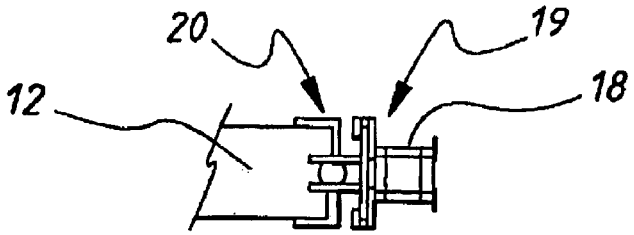
FIG. 3 is a schematic top plan view of the drilling rig of FIG. 1.

In FIGS. 1 to 7 of the accompanying drawings there is schematically depicted a drilling rig 10. The drilling rig 10 in this embodiment is attached to a vehicle 11. Typically the vehicle 11 would be an excavator.

The drilling rig 10 includes a telescopic boom 12 having a first end 13 adapted to be pivotally attached to the vehicle 11 for pivoting movement relative thereto about a generally horizontal axis. The boom 12 includes a base member 14 having the end 13 to be pivotally attached to the vehicle 11. The base 14 is telescopically received within an extension number 15 so as to be moveable relative to the base 14 in the direction of the arrow 16. The extension member 15 provides a second end 17 of the boom 12.

Mounted within the boom 12 is a first hydraulic ram 18 which causes telescopic extension and retraction of the boom 12.

The second end 17 is slidably attached to a leader 36 by means of a slide assembly 19. The slide assembly 19 includes a yoke 20 pivotally attached to the extension member 15 for pivoting movement about a horizontal axis 21. The yoke 21 has a stem 22 terminating with a flange 23. The flange 23 is slidably received within slots 24 provided by retaining assembly 25 which is part of the leader 36. The retaining assembly 25 includes longitudinally extending plates 26 and 27 joined by bolts 28. Retaining plates 29 and 30 provide the slots 24 which receive the flange 23. Bolts 30 extend between the retaining plates 29 and 30.

In a further embodiment the flange 23 is of a disk configuration to provide for limited angle of movement about the longitudinal axis 37. This movement is achieved by applying different pressures to the rams 32.

A pair of second hydraulic rams 32 extends between the leader 36 and second end 17 to cause linear movement between the boom 12 and leader 36. Each ram 32 is pivotally attached to the end 17 for movement about a generally horizontal axis, while also being pivotally attached to the leader 36 again for pivoting movement about a further generally horizontal axis. The linear movement of the leader 36 is generally perpendicular to the pivoting axis provided by the hydraulic ram 32.

Extending from adjacent the end 13 to an upper portion of the leader 36 is a third hydraulic ram 33. The ram 32 is pivotally attached to the boom 12 and leader 18 for pivoting movement relative thereto about generally horizontal axis.

The leader 36 is adapted to receive a drilling apparatus so that the drilling rig 10 can be used to drill piles.

The above-described drilling rig 10 has a number of advantages. Firstly, in its preferred construction it enables access to restricted sites and can also adapt to the slope of supporting ground surfaces. It also ameliorates problems in respect of setting up and transport.

The drilling rig 10 further includes a fourth hydraulic ram 34 which causes pivoting of the boom 12 about the horizontal axis 35 at the end 13. By operation of the hydraulic ram 14 the leader can be moved from a generally upright position, to a generally horizontal transport position overlaying the vehicle 11. By operation of the ram 33, the inclination of the leader 10 may be adjusted in a vertical plane. Operation of the rams 32 provides for raising and lowering of the leader 18.

Figure 8:
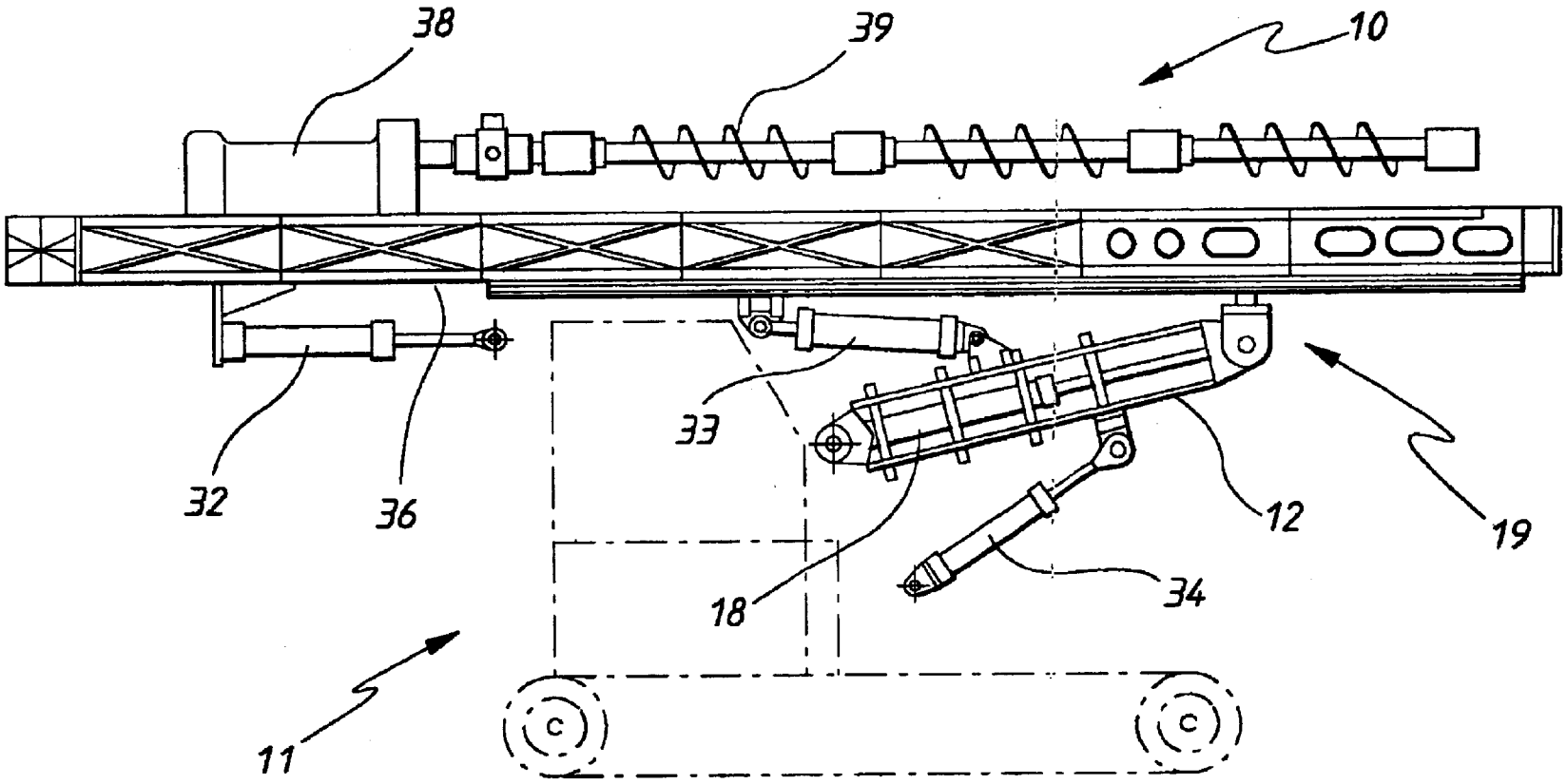
FIG. 8 is a schematic side elevation of a modification of the drilling rig of FIG. 1.

FIG. 8 is a schematic illustration of a modification of the previous embodiment. For ease of description the same reference numerals have been employed. In this embodiment the ram 33 has been replaced with a double acting multi stage hydraulic ram 33. Mounted on the leader 36 is a drill drive motor 38 drivingly connected to an auger string 39. It should further be noted that in this embodiment the ram 32 is attached to the boom 12 at a position adjacent the upper end thereof.

Figure 1:
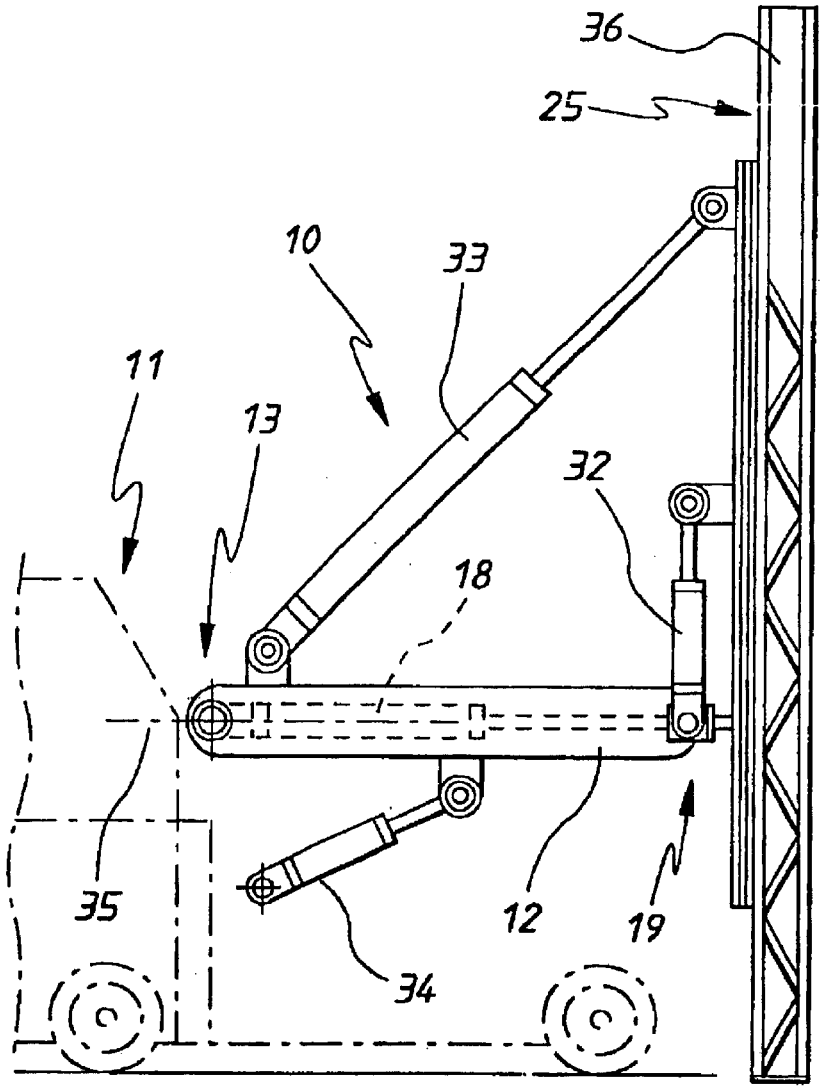
FIG. 1 is a schematic side elevation of a drilling rig.
Figure 2:
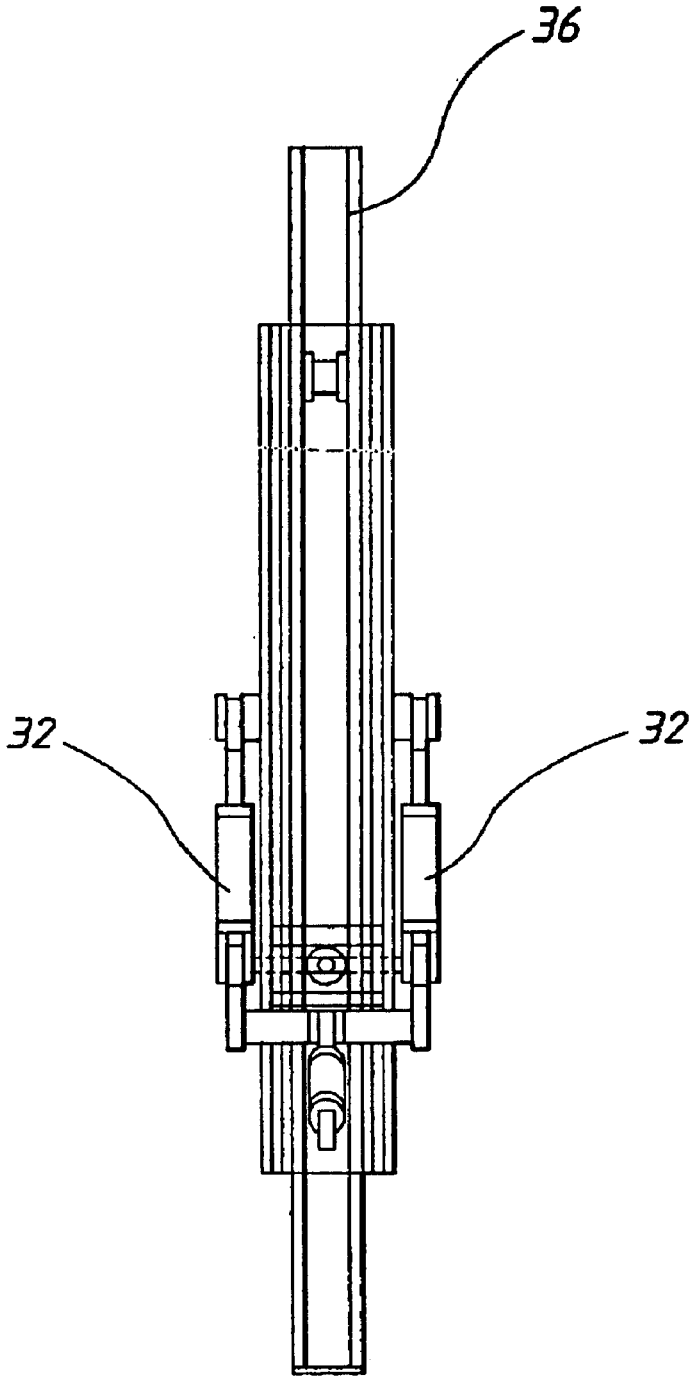
FIG. 2 is a schematic end elevation of the drilling rig of FIG. 1.
Figure 4:
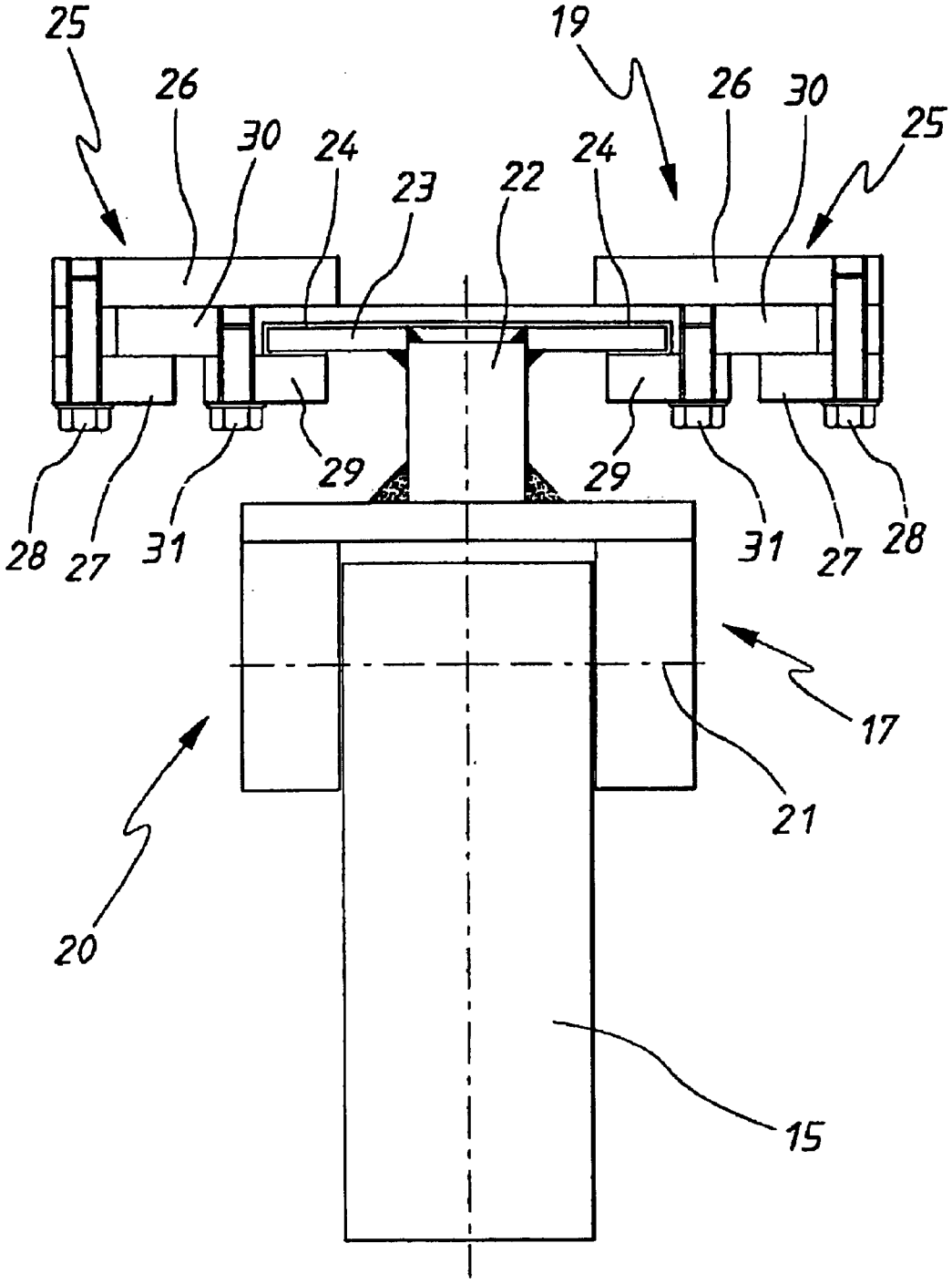
FIG. 4 is a schematic plan view of a slide assembly of the drilling rig of FIG. 1.
Figure 5:
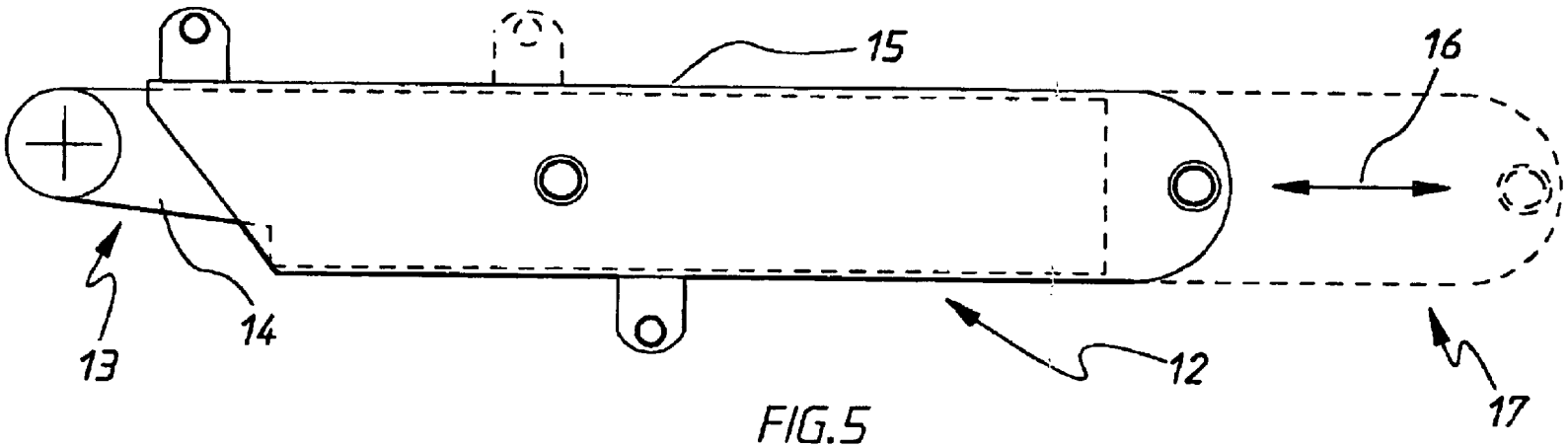
FIG. 5 is a schematic side elevation of the boom of the drilling rig of FIG. 1.
Figure 6:
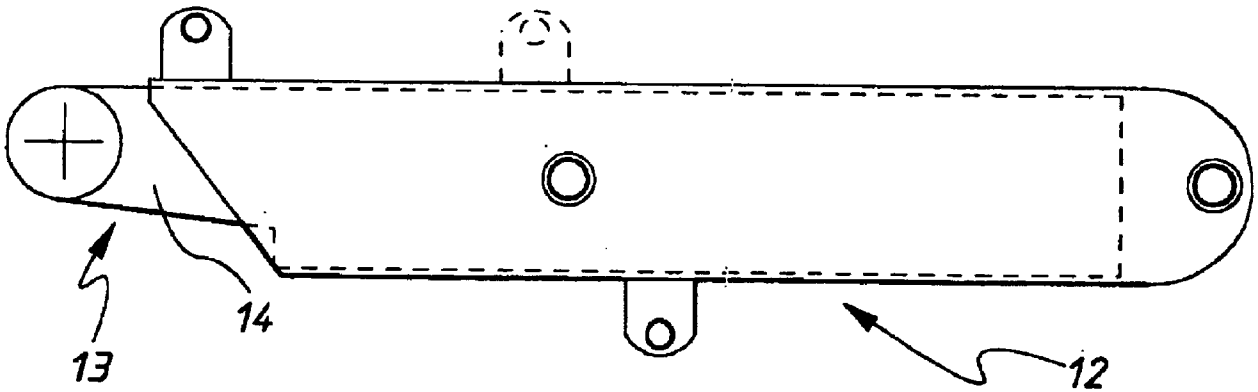
FIG. 6 is a further side elevation of the boom of FIG. 1.
Figure 7:
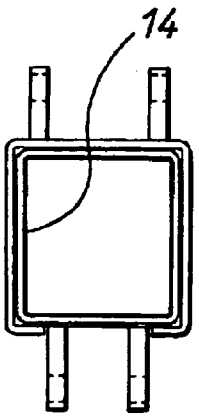
FIG. 7 is a schematic part section end elevation of the boom of FIGS. 5 and 6.

In FIG. 1 the rig 10 is illustrated with the leader 36 in a generally upright position. In FIG. 8 the leader 36 is illustrated in a generally horizontal transport orientation.

What is claimed is:

1. A drilling rig to be mounted on a vehicle providing hydraulic fluid under pressure, said rig including:

a telescopic boom having a first and second end, said first end being adapted to be pivotally attached to said vehicle for movement about a generally horizontal first axis;

a first hydraulic ram mounted on the boom to cause telescopic extension and retraction thereof;

a leader pivotally mounted on the second end for movement about a generally horizontal second axis, the second axis being generally transverse of said boom, the leader being adapted to support a drilling assembly;

a second hydraulic ram, the second ram being pivotally attached to said boom and pivotally attached to said leader and operable to cause linear movement of said leader relative to said boom;

an assembly attached said second end to said leader to provide for said linear movement of said leader relative to said second end in a direction generally perpendicular to said second axis; and a third hydraulic ram, the third ram extending between said boom and leader and being pivotally attached to the leader at a location spaced from said second end for pivoting movement about a generally horizontal fourth axis, the third ram being operable to cause pivoting of said leader about said second axis.

2. The drilling rig of claim 1 wherein said second hydraulic ram is attached to said boom adjacent the second end thereof.

3. The hydraulic rig of claim 1 including a further second hydraulic ram, both second hydraulic rams being pivotally attached to the boom and pivotally attached to the leader.

4. The drilling rig of claim 1 wherein said third hydraulic ram is a double acting multi stage hydraulic ram.

5. The drilling rig of claim 1 wherein said slide assembly includes a boom slide member slidably received by a leader slide member, the leader slide member extending longitudinally of the leader.

6. The drilling rig of claim 5 wherein said leader slide member includes a longitudinally extending slot within which the boom slide member is slidably received.

7. The drilling rig of claim 6 wherein said boom slide member is a disk received within said slot to provide for limited angular movement about an axis extending generally parallel to the boom.

* * * * *